US005722535A

United States Patent [19]

Nakajima

[11] Patent Number: 5,722,535

[45] Date of Patent: Mar. 3, 1998

[54] COAXIAL CONVERSION CONNECTOR

[75] Inventor: Hidenao Nakajima, Kawasaki, Japan

[73] Assignee: Fujitsu Limited, Kawasaki, Japan

[21] Appl. No.: 661,872

[22] Filed: Jun. 11, 1996

[30] Foreign Application Priority Data

Oct. 17, 1995 [JP] Japan ..... 7-268570

[51] Int. Cl.[6] ..... H01H 1/12

[52] U.S. Cl. ..... 200/504; 200/51.05

[58] Field of Search ..... 200/504, 507, 200/51.04, 51.05, 51.09, 51.03; 439/109, 578, 581, 582; 361/728, 729

[56] References Cited

U.S. PATENT DOCUMENTS

| | | | |
|---|---|---|---|
| 4,013,854 | 3/1977 | Workman | 200/504 |
| 4,206,332 | 6/1980 | Veenendaal | 200/504 |
| 4,749,968 | 6/1988 | Burroughs | 200/504 |

OTHER PUBLICATIONS

Abstract of Japan, JP-A-2-158072, issued Jun. 18, 1990, Shozo Yamada, Connection Structure of Different-Type Connector to Interface Package.

*Primary Examiner*—David J. Walczak
*Attorney, Agent, or Firm*—Staas & Halsey

[57] ABSTRACT

A coaxial conversion connector adapted to be detachably connected to a mating connector of an electronic device having a frame ground portion electrically connected to a frame ground in the vicinity of the mating connector, the mating connector having a plurality of first connecting portions. The coaxial conversion connector includes a coaxial jack adapted to receive a coaxial cable having one end equipped with a coaxial plug, the coaxial jack having a cylindrical first metal member adapted to be electrically connected through the coaxial plug to an outer conductor of the coaxial cable, and a second metal member adapted to be electrically connected through the coaxial plug to a central conductor of the coaxial cable; a plurality of second connecting portions electrically connected to both the first metal member and the second metal member, the second connecting portions being adapted to be respectively electrically connected to the first connecting portions of the mating connector; an FG contact member provided in the vicinity of the second connecting portions, the FG contact member being formed from an elastic metal member adapted to come into pressure contact with the frame ground portion of the electronic device; and an FG switching mechanism for switching continuity and discontinuity between the outer conductor of the coaxial cable and the FG contact member.

5 Claims, 14 Drawing Sheets

COAXIAL CONVERSION CONNECTOR

BACKGROUND OF THE INVENTION

1. Field of the Invention

The present invention relates to a coaxial conversion connector for connecting to an electronic device such as a communication device (exchange or transmitter) a coaxial cable used for connection with another electronic device.

2. Description of the Related Art

FIG. 11 is a sectional view of a communication device (electronic device) with which a conventional coaxial conversion connector is engaged. In FIG. 11, reference numeral denotes a metal casing of the communication device. The casing 11 stores a plurality of electronic circuit packages 12. Each electronic circuit package 12 includes a printed wiring board and a plurality of electronic components (not shown) such as ICs and LSIs mounted on the printed wiring board. A plurality of connectors (female connectors) 12*a* are mounted on a front end portion of the electronic circuit package 12. Reference numeral 13 denotes a back board fixed by screws to the back surface of the casing 11 so as to close back openings of the casing 11. A plurality of connectors (male connectors) 13*a* respectively engaged with the connectors 12*a* of the electronic circuit package 12 are arranged and mounted on the inner surface of the back board 13.

A plurality of connectors (male connectors) 14*a* supported by metal supporting members 14 are mounted on the outer surface of the back board 13. Pins of each connector 14*a* are formed integrally with corresponding pins of each connector 13*a*. Each connector 14*a* is a connector adapted to engage with a coaxial conversion connector 16 for connecting coaxial cables 15 for signal transmission and reception to another communication device. Each coaxial cable 15 includes a central conductor surrounded by an inner insulator, and an outer conductor (shielded line) surrounded by an outer insulator. The outer insulator is partially removed at an end portion of the coaxial cable 15, and a coaxial plug 15*a* is mounted at this portion.

The coaxial conversion connector 16 is configured as shown in FIGS. 12, 13, 14A, and 14B. In these figures, reference numeral 17 denotes a connector body. The connector body 17 has at its end portion a female contact 18 formed with a plurality of metallized holes 18*a* including metal pieces. The pins of the connector 14*a* of the communication device are adapted to be inserted into the metallized holes 18*a* and be connected to the metal pieces mounted in the metallized holes 18. A pair of substantially cylindrical coaxial jacks 19 are provided in the connector body 17. The coaxial plug 15*a* of the coaxial cable 15 is adapted to be inserted into each coaxial jack 19. One of the coaxial jacks 19 is intended for transmission, and the other is intended for reception.

Each coaxial jack 19 has a metal barrel 19*a* and a metal terminal 19*b*. The outer conductor of the coaxial cable 15 is adapted to come into contact with the barrel 19*a*, and the central conductor of the coaxial cable 15 is adapted to come into contact with the terminal 19*b*. The barrel 19*a* and the terminal 19*b* are connected through conductive wires 20 to the corresponding metallized holes 18*a* of the female contact 18. After inserting the coaxial plugs 15*a* of the coaxial cables 15 for transmission and reception into the respective coaxial jacks 19, the coaxial conversion connector 16 is brought into engagement with the connector 14*a* of the communication device, thus obtaining the continuity between the coaxial cables 15 and the electronic circuit package 12.

In some cases, it is necessary to connect the outer conductor (shielded line) of the coaxial cable to a frame ground (FG) of the electronic device, so as to obtain a near ground potential. The continuity of the outer conductor of the coaxial cable to the frame ground of the electronic device may be obtained by providing an elastic metal member on the coaxial conversion connector, connecting the outer conductor of the coaxial cable to this metal member, and bringing this metal member into pressure contact with a part of the metal casing of the electronic device by engaging the coaxial conversion connector with the connector of the electronic device. However, in the case that the potentials of the frame grounds of two electronic devices (e.g., an exchange and a transmitter) connected to the opposite ends of the coaxial cable are different from each other, the connection of the outer conductor of the coaxial cable to the frame grounds of both the electronic devices may cause a problem. Therefore, the outer conductor of the coaxial cable is sometimes connected to the frame ground of one of the two electronic devices. Accordingly, it is necessary to switch the continuity and the discontinuity between the outer conductor of the coaxial cable and the frame ground of either electronic device according to situations, and such a switching operation must be easily carried out.

SUMMARY OF THE INVENTION

It is therefore an object of the present invention to provide a coaxial conversion connector which can easily switch the continuity and the discontinuity between the outer conductor of a coaxial cable and the frame ground of an electronic device to be connected through this coaxial cable to another electronic device.

In accordance with an aspect of the present invention, there is provided a coaxial conversion connector adapted to be detachably connected to a mating connector of an electronic device having a frame ground portion electrically connected to a frame ground in the vicinity of the mating connector, the mating connector having a plurality of first connecting portions; the coaxial conversion connector comprising a coaxial jack adapted to receive a coaxial cable having one end equipped with a coaxial plug, the coaxial jack having a cylindrical first metal member adapted to be electrically connected through the coaxial plug to an outer conductor of the coaxial cable, and a second metal member adapted to be electrically connected through the coaxial plug to a central conductor of the coaxial cable; a plurality of second connecting portions electrically connected to both the first metal member and the second metal member, the second connecting portions being adapted to be respectively electrically connected to the first connecting portions of the mating connector; an FG contact member provided in the vicinity of the second connecting portions, the FG contact member being formed from an elastic metal member adapted to come into pressure contact with the frame ground portion of the electronic device; and an FG switching means for switching continuity and discontinuity between the outer conductor of the coaxial cable and the FG contact member.

In operation, when the coaxial cable is inserted into the coaxial jack of the coaxial conversion connector according to the present invention, and the coaxial conversion connector is then engaged with the mating connector of the electronic device, the FG contact member comes into pressure contact with the frame ground portion of the electronic device, so that the outer conductor of the coaxial cable is electrically connected to the frame ground. In canceling the continuity between the outer conductor of the coaxial cable and the frame ground, the FG switching means is operated to select the discontinuity. Thus, the continuity and the discontinuity between the outer conductor of the coaxial cable and the frame ground of the electronic device can be easily switched by operating the FG switching means.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

First Preferred Embodiment

Figure 1:
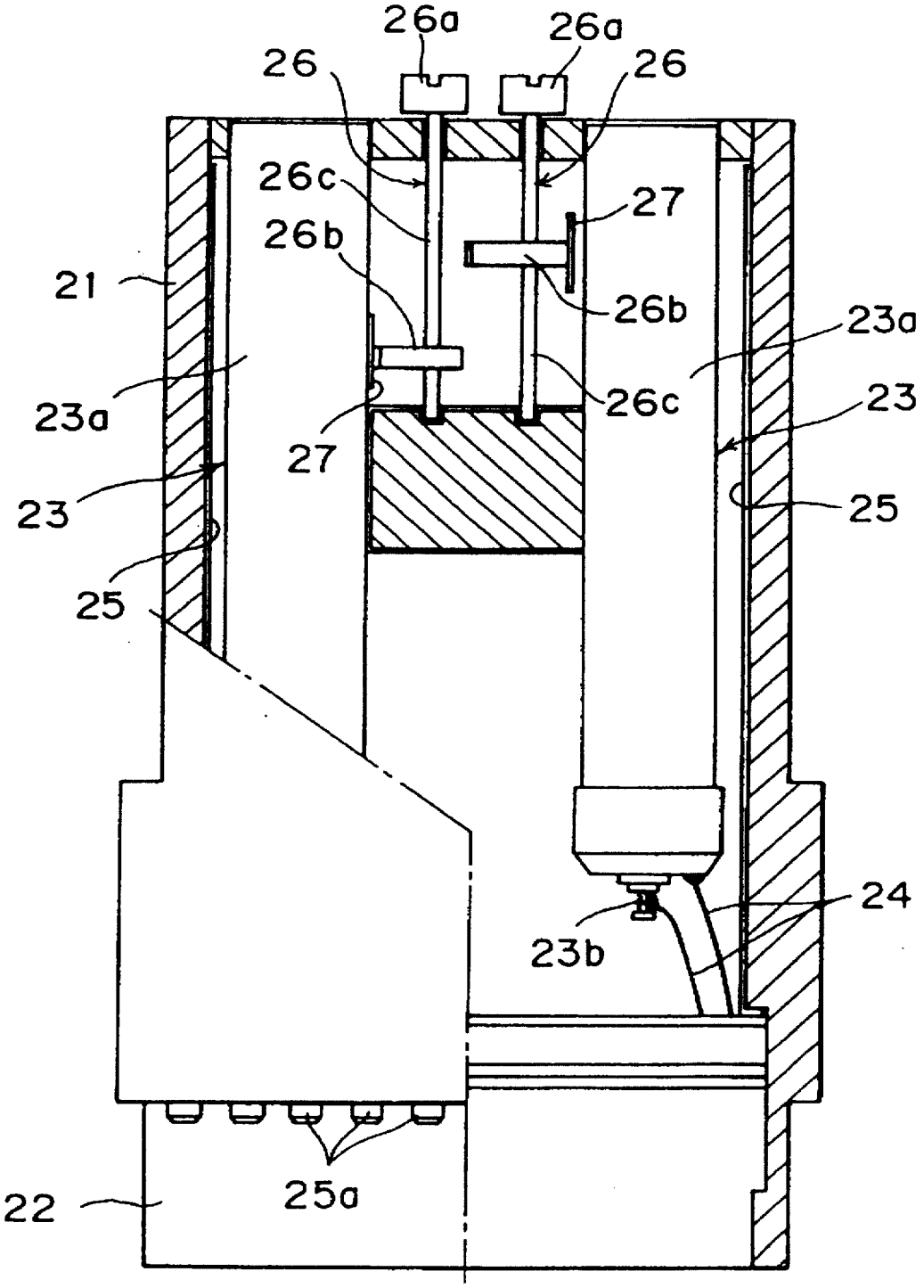
FIG. 1 is a partially cutaway, elevational view of a coaxial conversion connector according to a first preferred embodiment of the present invention.
Figure 2:
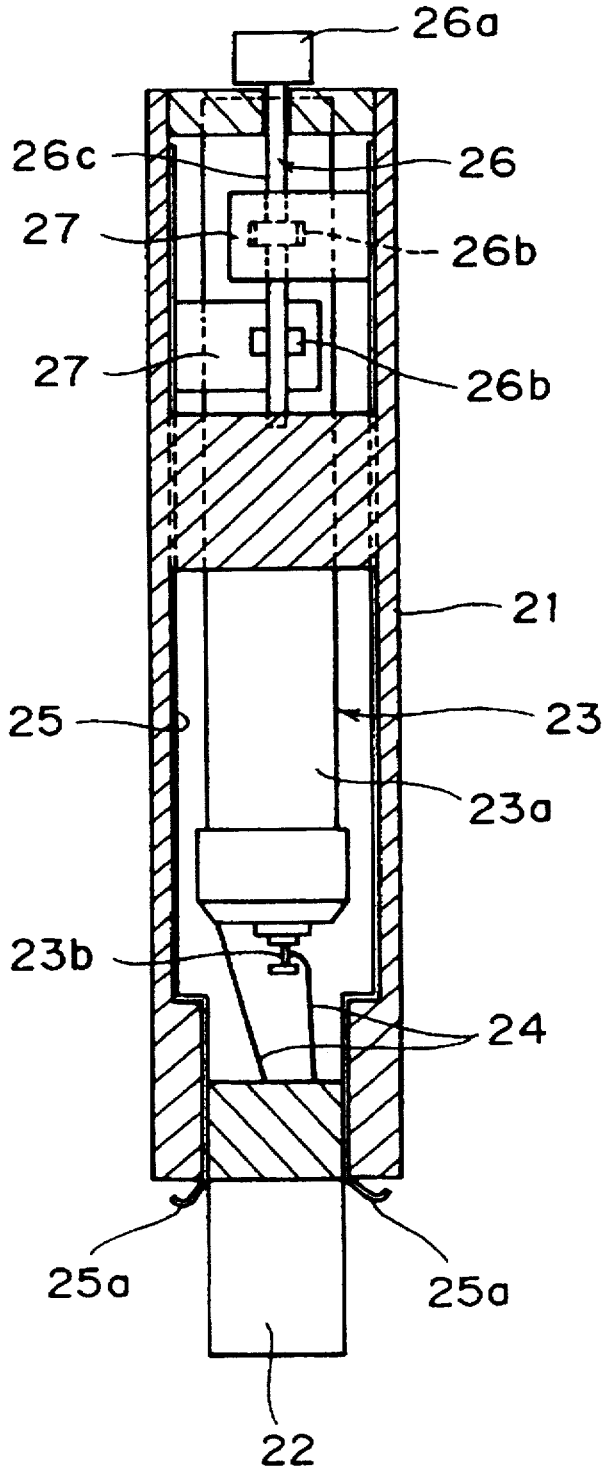
FIG. 2 is a sectional side view of the coaxial conversion connector shown in FIG. 1.

FIGS. 1, 2, 3A, and 3B are views showing a coaxial conversion connector according to a first preferred embodiment of the present invention. In these figures, reference numeral 21 denotes a connector body. The connector body 21 has at its end portion a female contact 22 formed with a plurality of metallized holes 22a (second connecting portions) including metal pieces. Pins (first connecting portions) of a connector of a communication device are adapted to be inserted into the metallized holes 22a and be connected to the metal pieces mounted in the metallized holes 22a. A pair of substantially cylindrical coaxial jacks 23 are provided in the connector body 21. A coaxial plug mounted at one end of a coaxial cable is adapted to be inserted into each coaxial jack 23. One of the coaxial jacks 23 is intended for transmission, and the other is intended for reception. Each coaxial jack 23 has a metal barrel 23a (first metal member) and a metal terminal 23b (second metal member). An outer conductor of the coaxial cable is adapted to come into contact with the barrel 23a, and a central conductor of the coaxial cable is adapted to come into contact with the terminal 23b. The barrel 23a and the terminal 23b are connected through conductive wires 24 to the corresponding metallized holes 22a of the female contact 22.

A metal shell 25 is provided on the inside surface of the connector body 21. A part of the metal shell 25 in the vicinity of a base portion of the female contact 22 is formed like a comb. The comblike portion of the shell 25 is exposed at its front end from the connector body 21 and bent outward in opposite directions to form a plurality of frame ground contact plate portions 25a (first contact member) having elasticity. A pair of FG switching means are located in a portion of the connector body 21 interposed between the pair of coaxial jacks 23. Each FG switching means comprises a switching shaft 26 (switching member) and a contact plate 27 (second contact member). The switching shaft 26 comprises a shaft portion 26c rotatably supported to the connector body 21, a knob portion 26a formed at one end of the shaft portion 26c and exposed from the connector body 21, and a cam portion 26b formed at the intermediate of the shaft portion 26c and located inside the connector body 21. The knob portion 26a and the cam portion 26b are formed integrally with the shaft portion 26c.

Figure 3A:
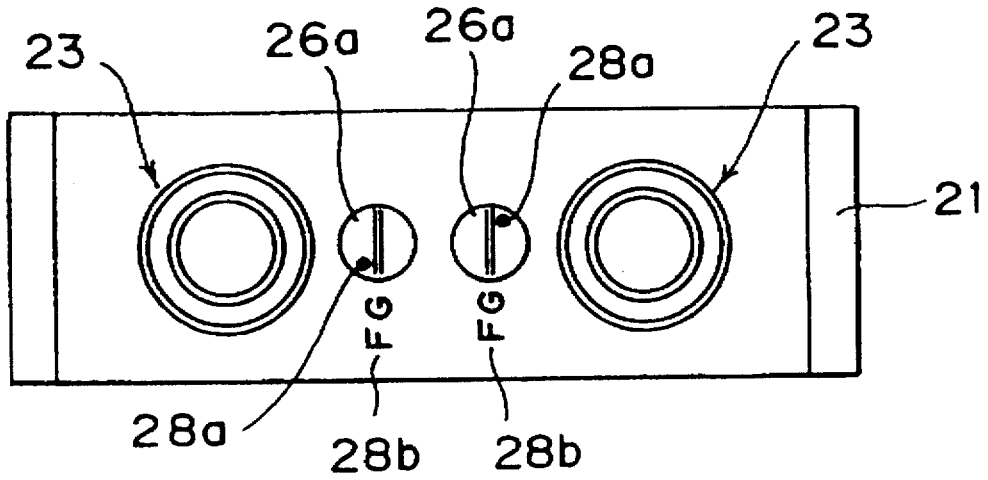
FIG. 3A is a top plan view of the coaxial conversion connector shown in FIG. 1.
Figure 3B:
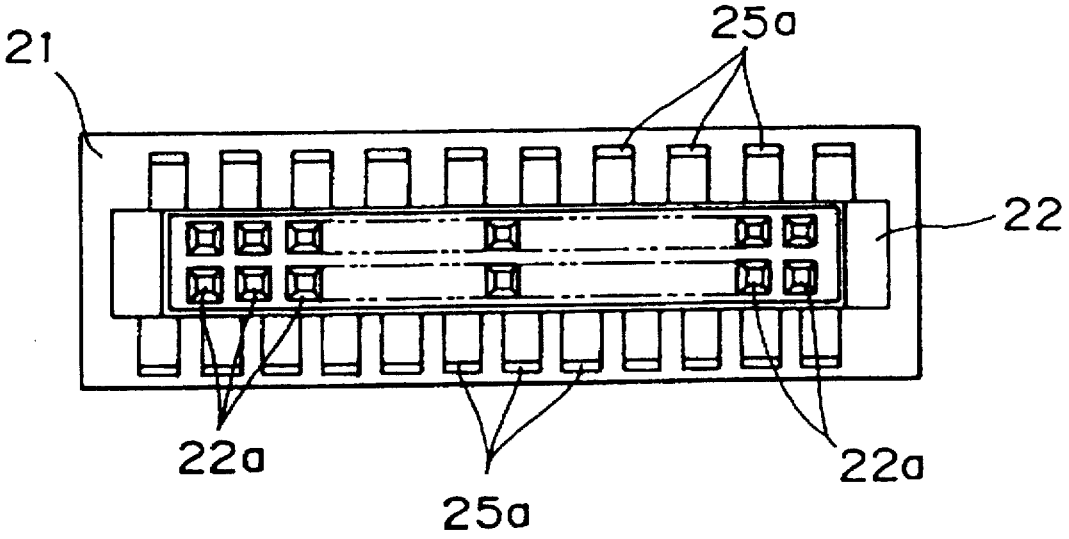
FIG. 3B is a bottom plan view of the coaxial conversion connector shown in FIG. 1.
Figure 4:
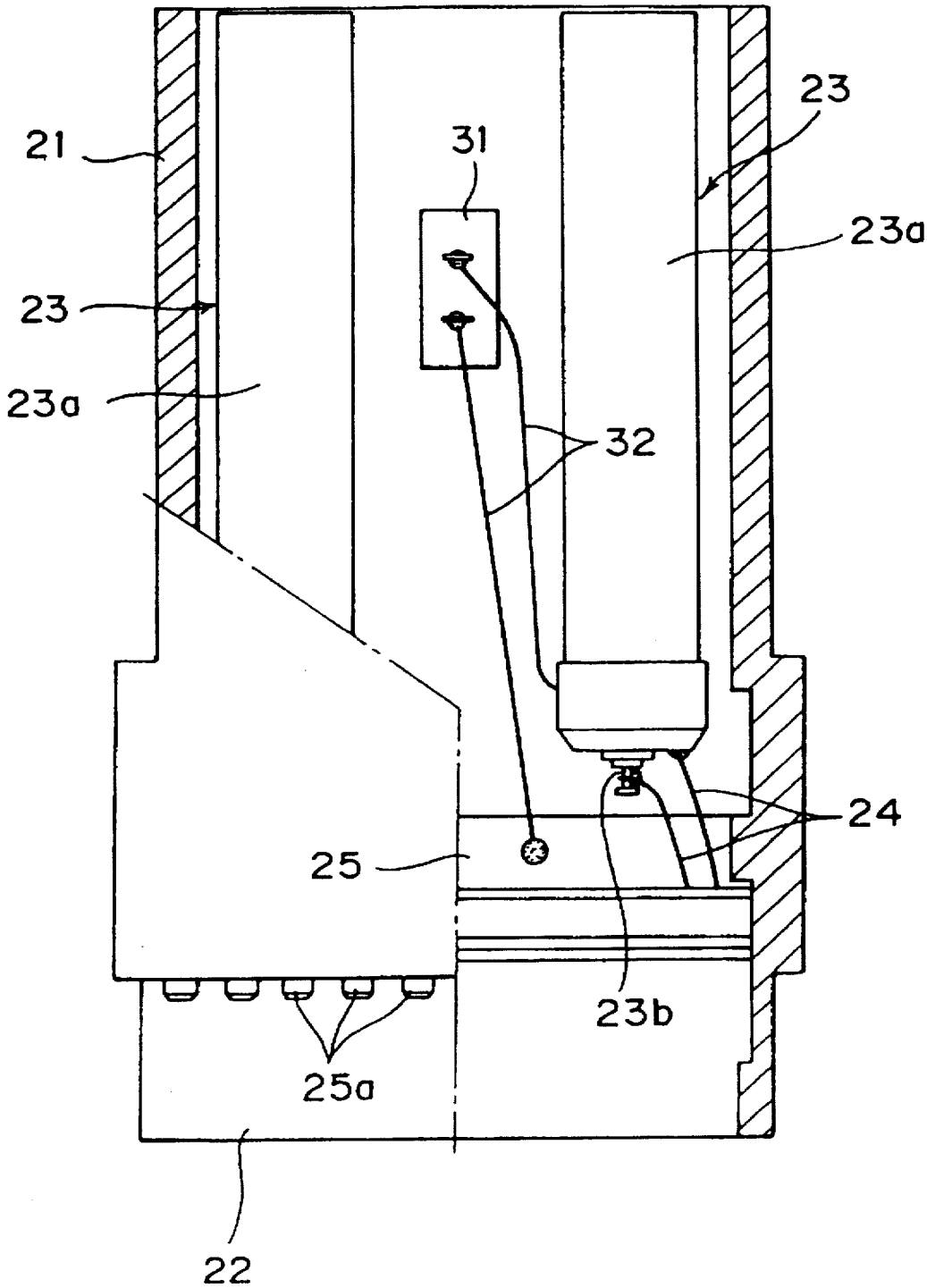
FIG. 4 is a partially cutaway, elevational view of a coaxial conversion connector according to a second preferred embodiment of the present invention.
Figure 5:
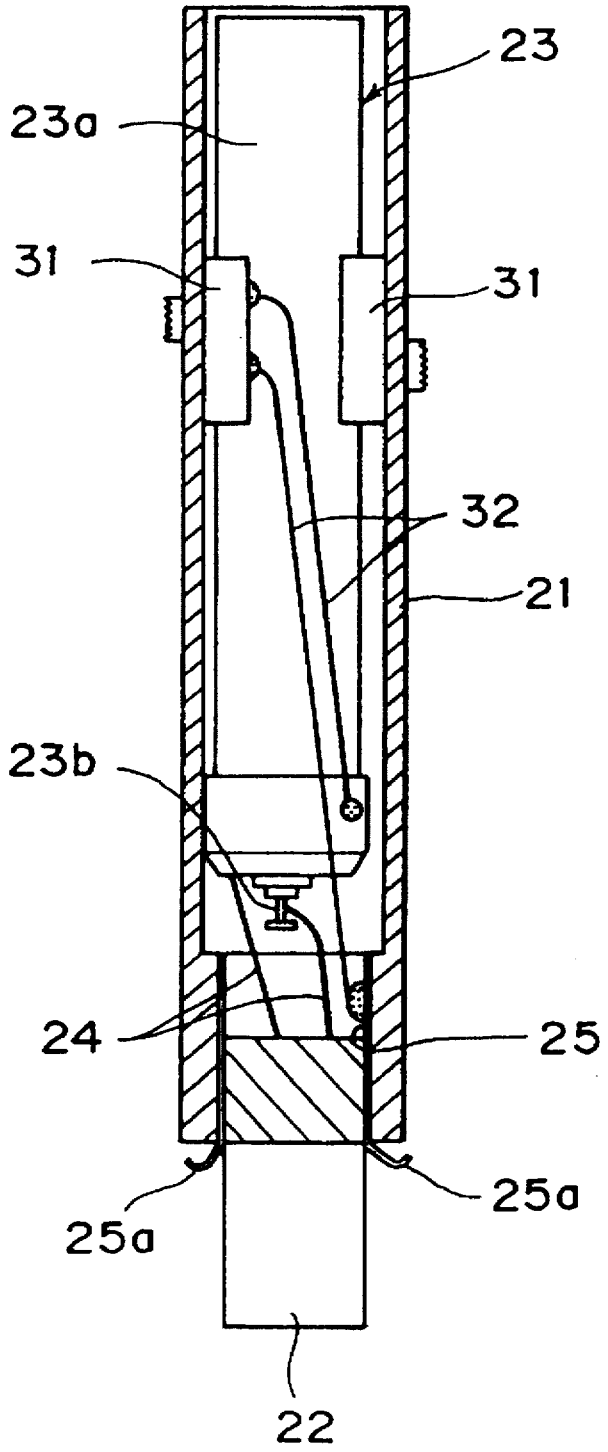
FIG. 5 is a sectional side view of the coaxial conversion connector shown in FIG. 4.
Figure 6A:
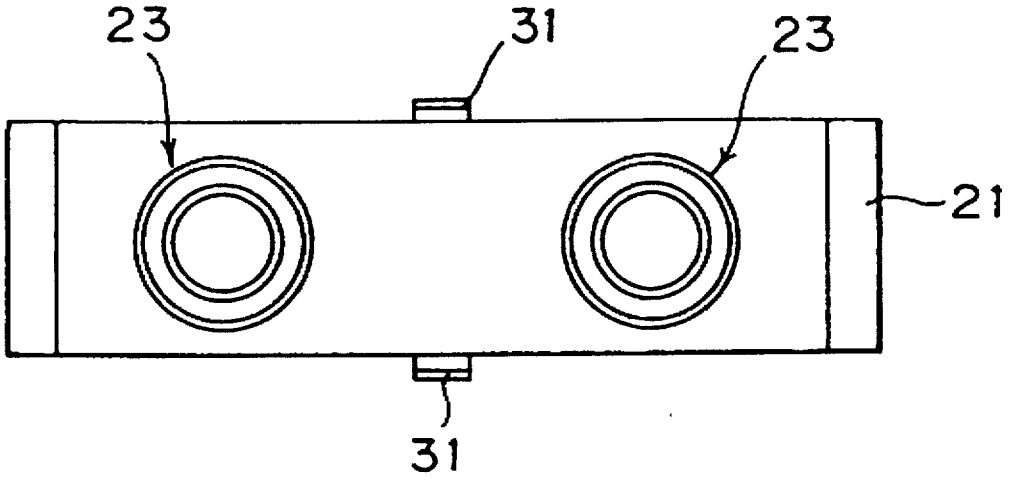
FIG. 6A is a top plan view of the coaxial conversion connector shown in FIG. 4.
Figure 6B:
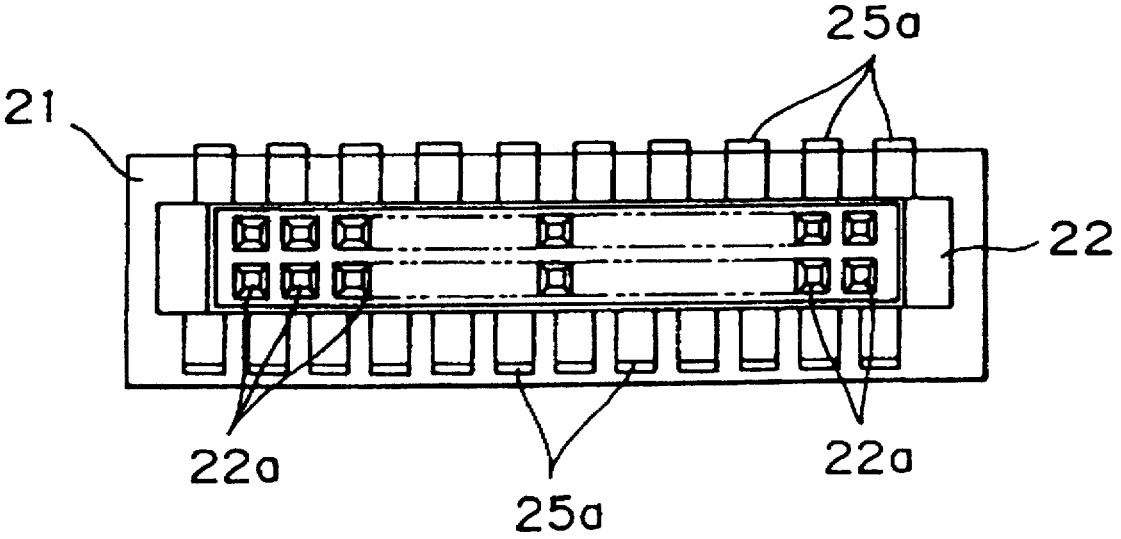
FIG. 6B is a bottom plan view of the coaxial conversion connector shown in FIG. 4.

Each contact plate 27 is formed from an elastic metal plate continuous to the shell 25, and it is located between the cam portion 26b of the corresponding switching shaft 26 and the corresponding coaxial jack 23 in such a manner as to be slightly spaced from the coaxial jack 23 in a free condition. Each contact plate 27 is formed integrally with the shell 25 or electrically connected to the shell 25. When the cam portion 26b is rotated by rotating the knob portion 26a of the corresponding switching shaft 26, the contact plate 27 is urged by the cam portion 26b to come into pressure contact with the barrel 23a of the corresponding coaxial jack 23, or the pressure contact of the contact plate 27 with the barrel 23a is canceled. As shown in FIG. 3A, the knob portion 26a of each switching shaft 26 has a printed mark "." 28a, and the connector body 21 has a printed mark "FG" 28b in the vicinity of each knob portion 26a. When each switching shaft 26 is set (rotated) so that its own mark 28a comes close to the corresponding mark 28b, this set position indicates that the outer conductor of the corresponding coaxial cable is electrically connected to the frame ground, that is, it is in a short condition. Conversely, when each switching shaft 26 is set (rotated) so that its own mark 28a comes away from the corresponding mark 28b, this set position indicates that the outer conductor of the corresponding coaxial cable is not electrically connected to the frame ground, that is, it is in an open condition.

In operation, the coaxial plugs of the coaxial cables for transmission and reception are inserted into and connected to the respective coaxial jacks 23, and the knob portions 26a of the switching shafts 26 are rotated by using a screwdriver or the like to select either the continuity (short condition) or the discontinuity (open condition) of the outer conductors of the coaxial cables to the frame ground. In the case of a communication device, the switching shafts 26 are generally set so that the outer conductor of the coaxial cable for reception becomes a short condition and the outer conductor of the coaxial cable for transmission becomes an open condition. When the connector body 21 is next brought into engagement with the mating connector of the communication device, the pins of the mating connector are inserted (forced) into the metallized holes 22*a* of the female contact 22, thus obtaining the continuity between the coaxial cables and an electronic circuit package in the communication device. In this condition, the frame ground contact plates 25*a* are kept in pressure contact with a metal supporting member of the mating connector of the communication device or a metal casing or the like (frame ground portion) of the communication device, thus obtaining the continuity of the outer conductors of the coaxial cables through the contact plates 27 and the shell 25 to the frame ground of the communication device.

According to the first preferred embodiment, the continuity or the discontinuity of the outer conductors of the coaxial cables to the frame ground of the communication device can be selected by rotating the switching shafts 26. Accordingly, the selection between the continuity and the discontinuity can be easily made in the field. Further, which of the open condition or the short condition each coaxial jack 23 is set in can be easily recognized by sight according to a relative positional relation between the mark "." 28*a* printed on the knob portion 26*a* of each switching shaft 26 and the corresponding mark "FG" 28*b* printed on the connector body 21, thereby avoiding missetting.

Second Preferred Embodiment

Figure 7:
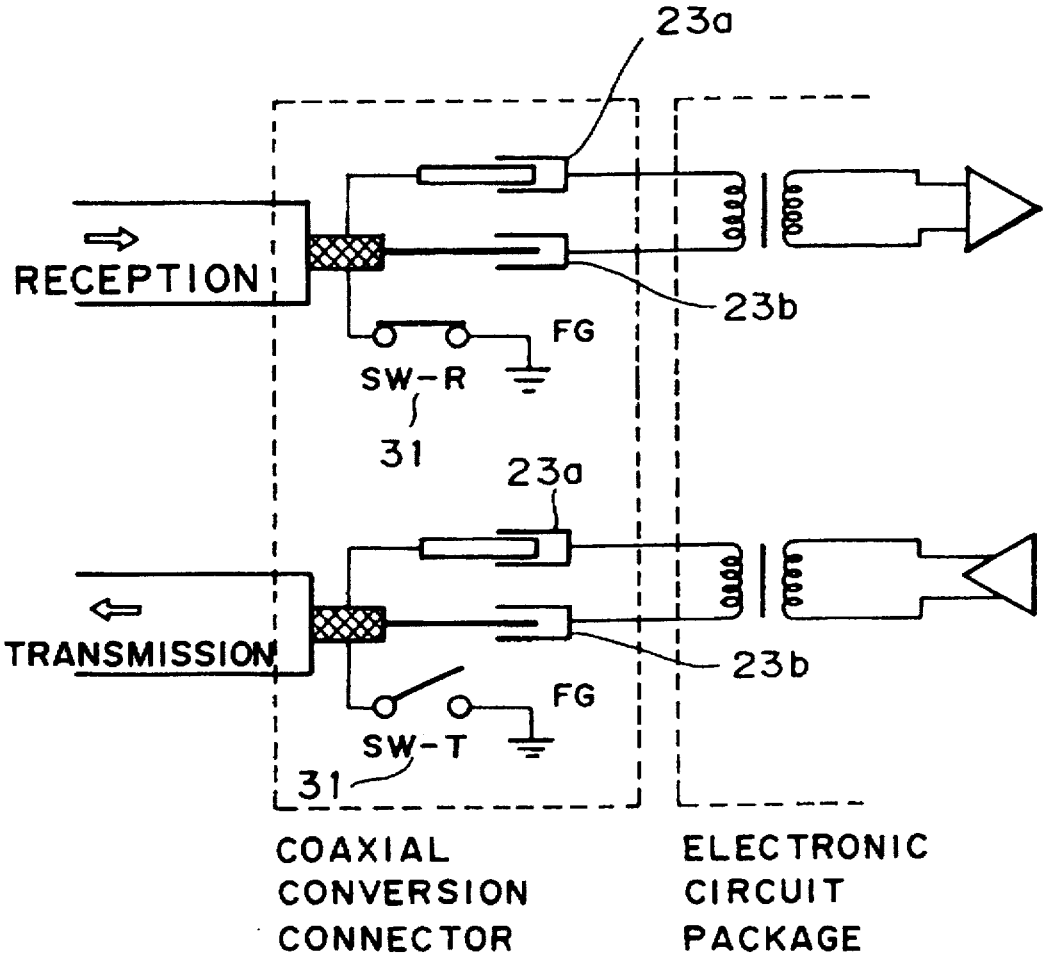
FIG. 7 is a circuit diagram showing the connection between coaxial cables engaged in the coaxial conversion connector shown in FIG. 4 and an electronic circuit package.
Figure 8:
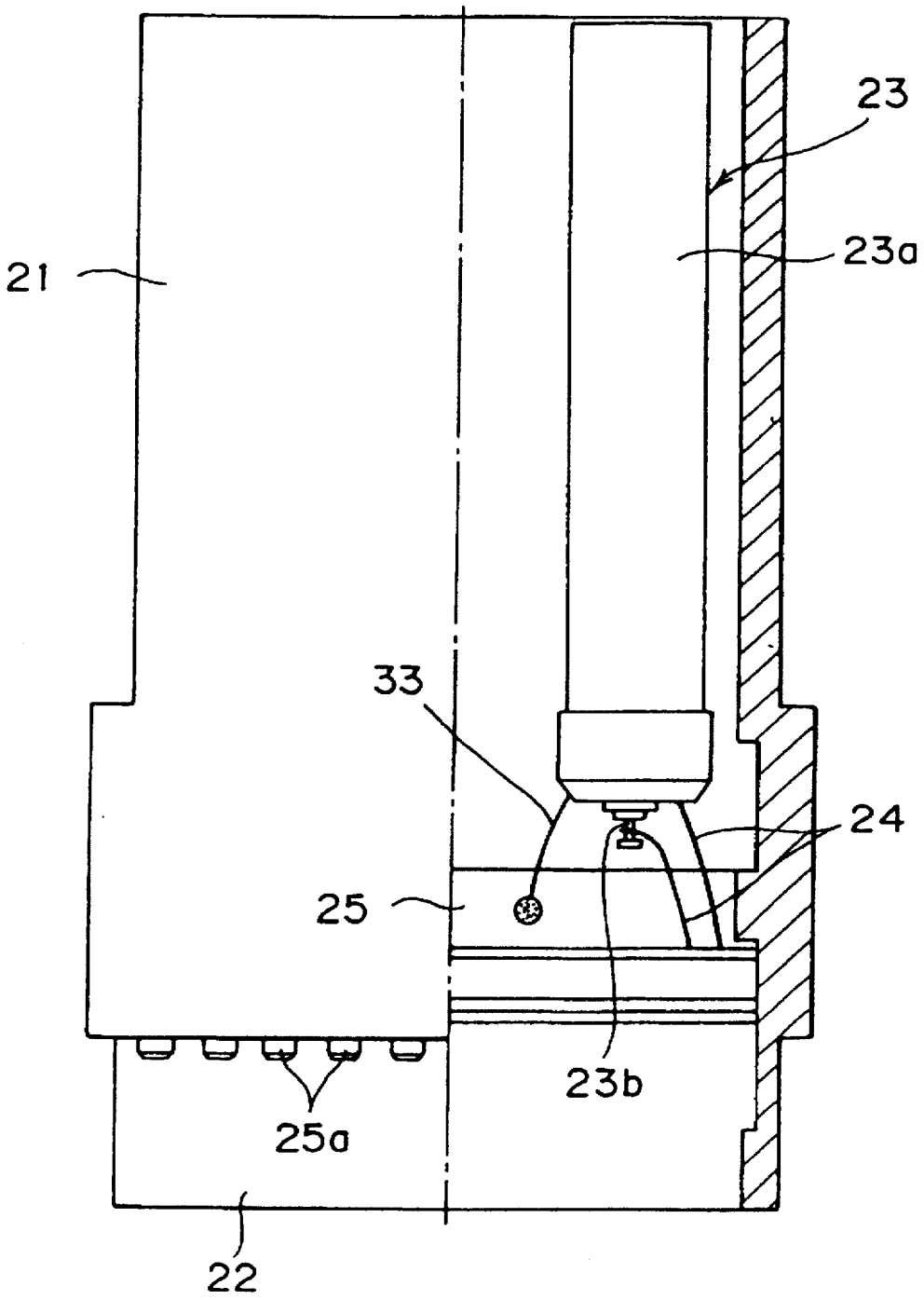
FIG. 8 is a partially cutaway, elevational view of a coaxial conversion connector according to a third preferred embodiment of the present invention.
Figure 9:
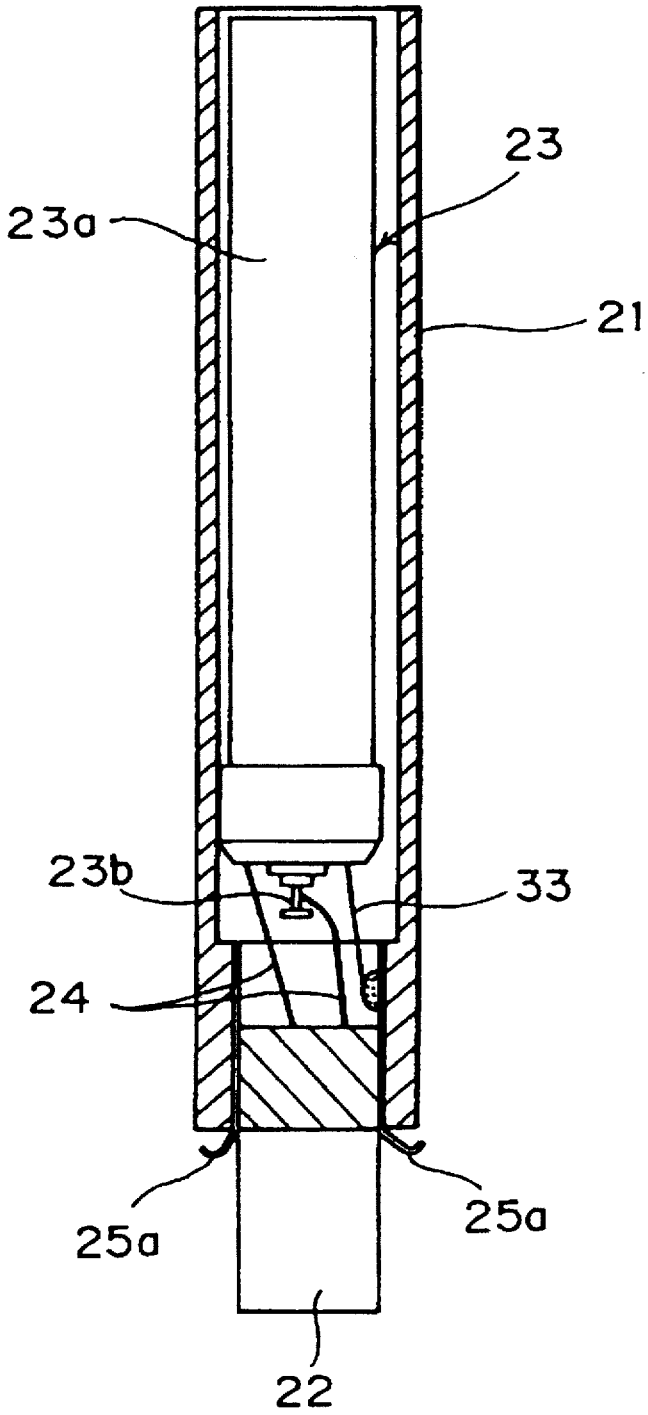
FIG. 9 is a sectional side view of the coaxial conversion connector shown in FIG. 8.
Figure 10A:
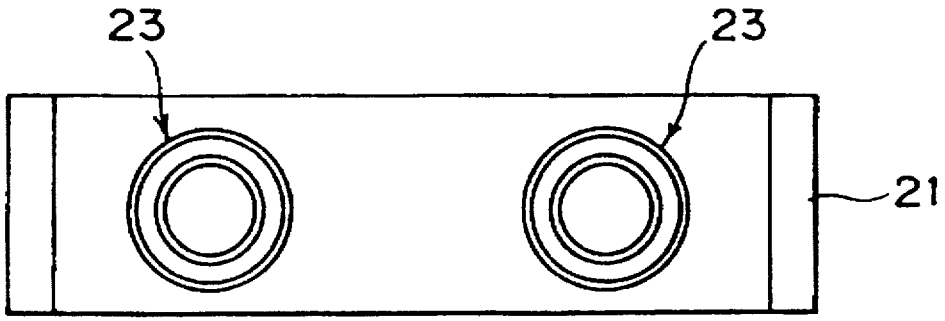
FIG. 10A is a top plan view of the coaxial conversion connector shown in FIG. 8.
Figure 10B:
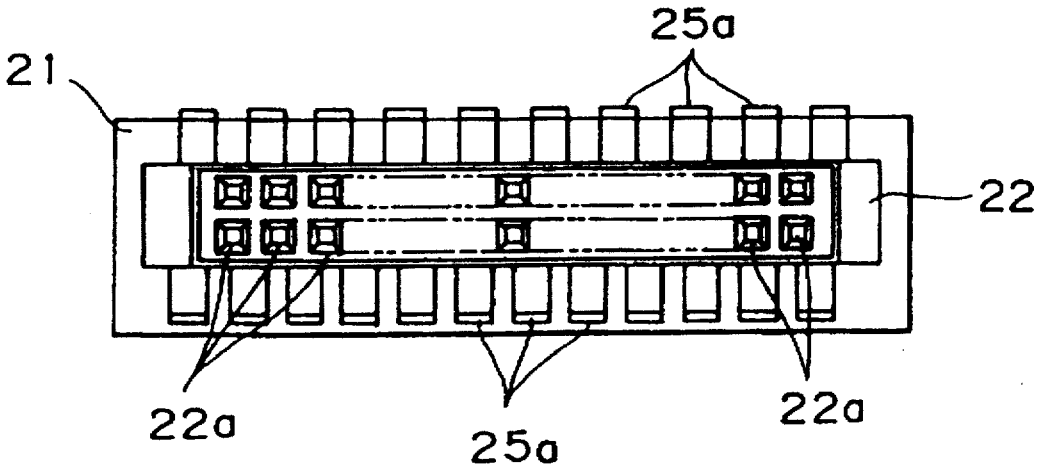
FIG. 10B is a bottom plan view of the coaxial conversion connector shown in FIG. 8.
Figure 11:
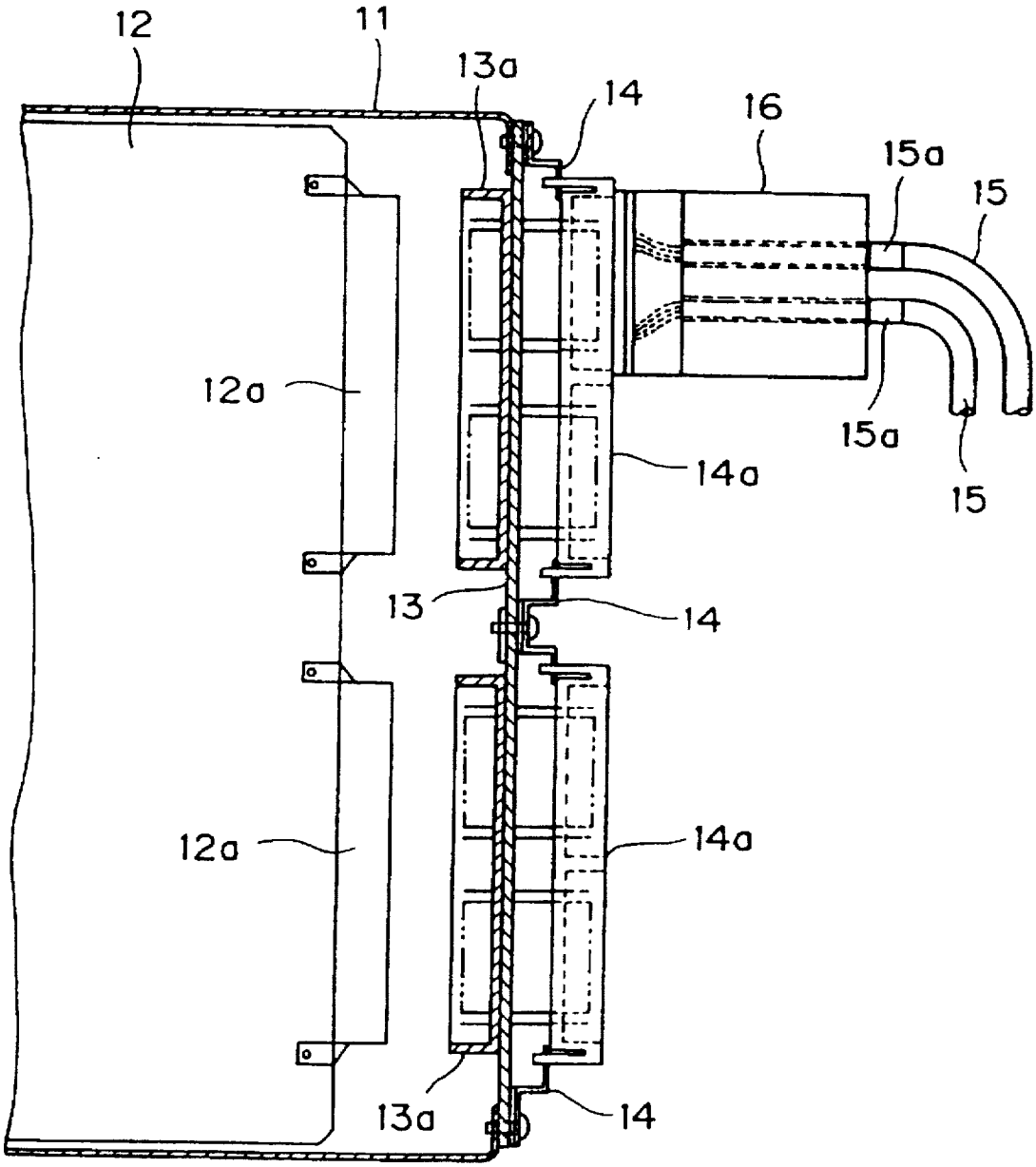
FIG. 11 PRIOR ART
FIG. 11 is a sectional view of a communication device (electronic device) with which a conventional coaxial conversion connector is engaged.
Figure 12:
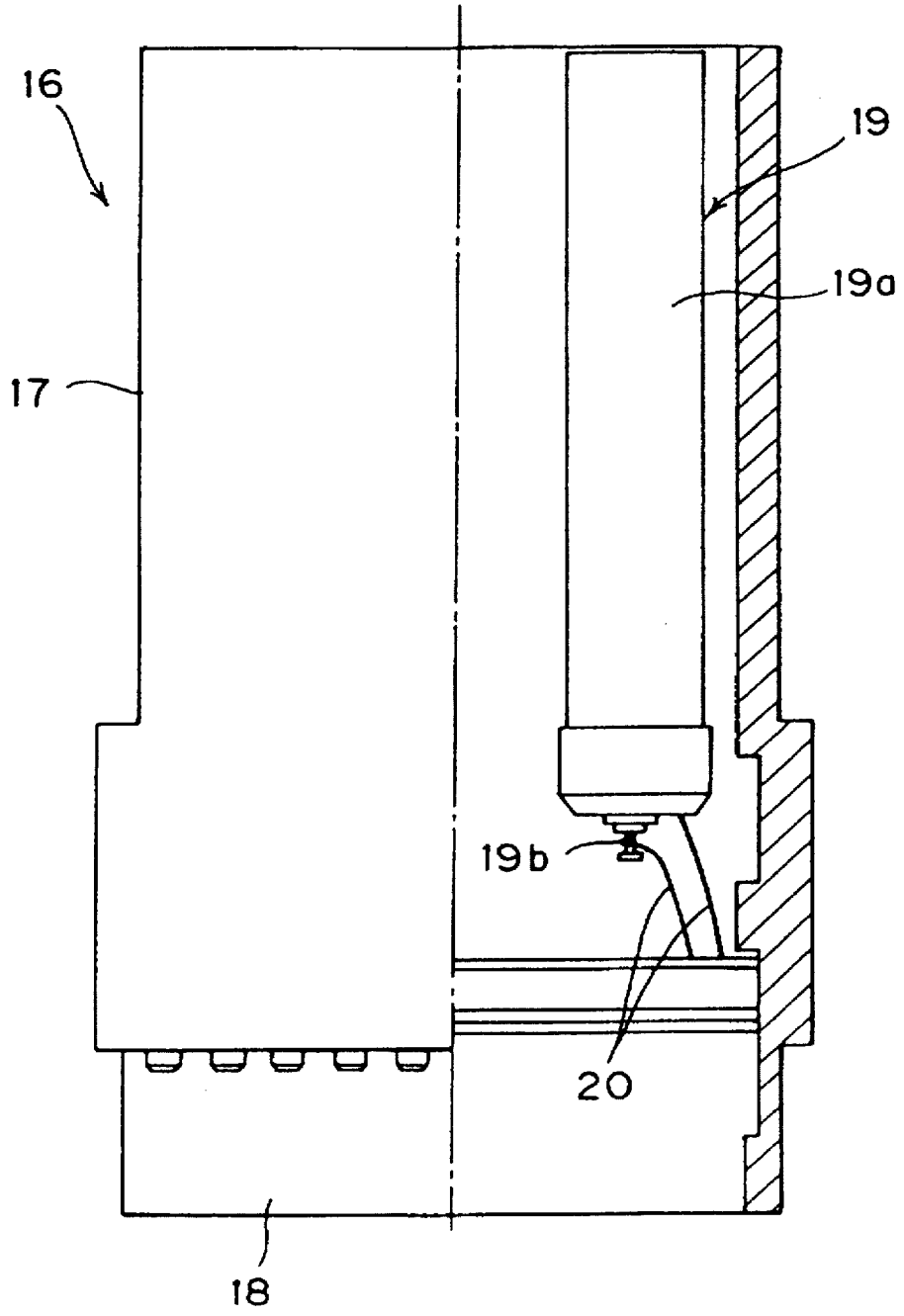
FIG. 12 PRIOR ART
FIG. 12 is a partially cutaway, elevational view of the conventional coaxial conversion connector shown in FIG. 11.
Figure 13:
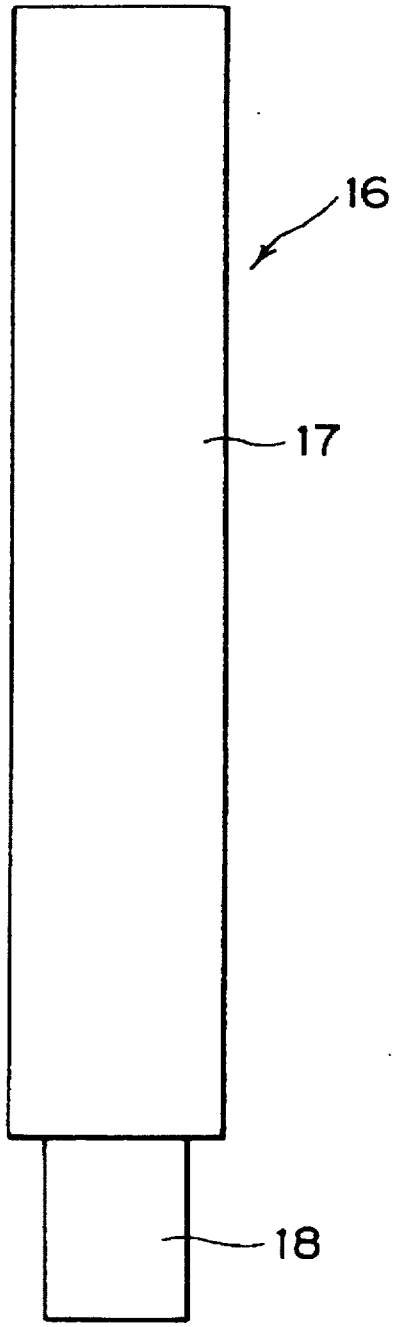
FIG. 13 PRIOR ART
FIG. 13 is a sectional side view of the coaxial conversion connector shown in FIG. 12.
Figure 14A:
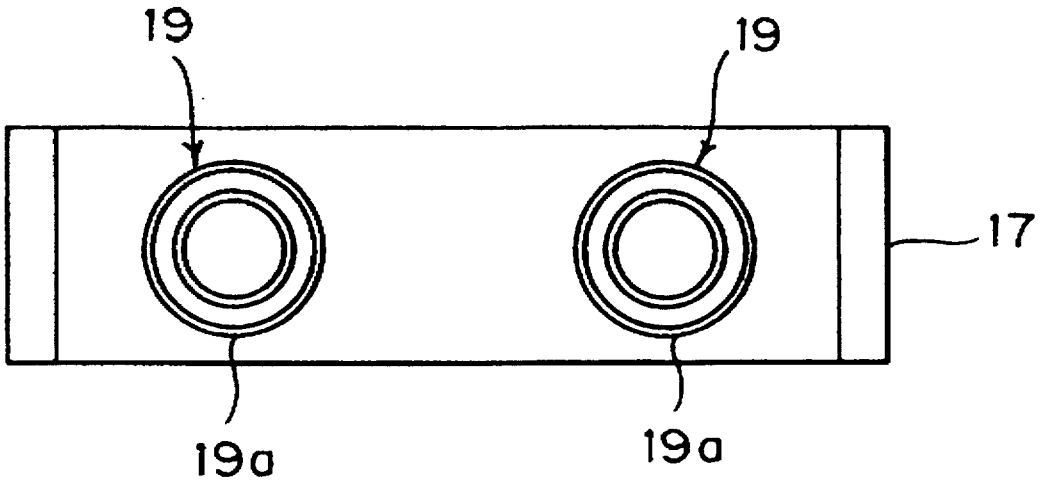
FIG. 14A PRIOR ART
FIG. 14A is a top plan view of the coaxial conversion connector shown in FIG. 12.
Figure 14B:
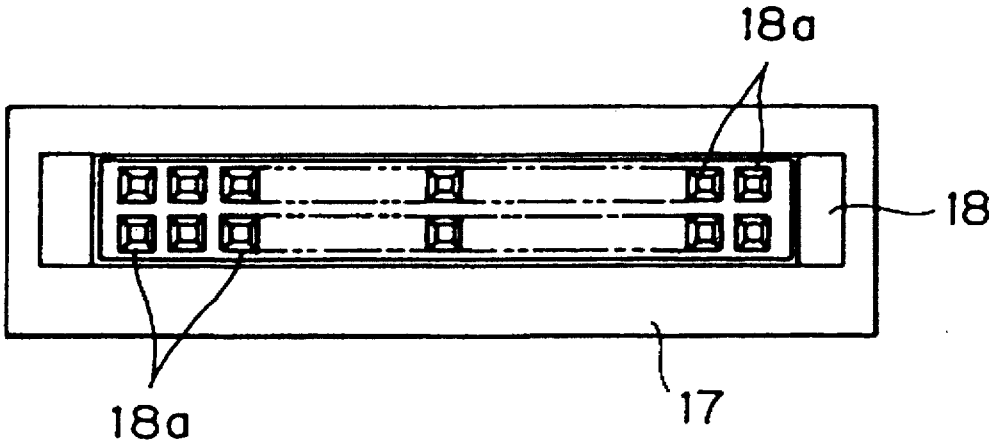
FIG. 14B PRIOR ART
FIG. 14B is a bottom plan view of the coaxial conversion connector shown in FIG. 12.

FIGS. 4, 5, 6A, 6B, and 7 are views showing a coaxial conversion connector according to a second preferred embodiment of the present invention. Substantially the same parts as those in the first preferred embodiment will be denoted by the same reference numerals, and the description thereof will be omitted. In the second preferred embodiment, the pair of FG switching means each comprising the switching shaft 26 and the contact plate 27 in the first preferred embodiment are replaced by a pair of FG switching means each having the following configuration. That is, each FG switching means comprises conductive wires 32 electrically connected to a barrel 23*a* of a coaxial jack 23 and a shell 25, and a slide switch 31 interposed and connected between the wires 32. As shown in FIG. 7, the open condition or the short condition of each coaxial jack 23 can be easily selected by turning on or off the corresponding slide switch 31. Further, which of the open condition or the short condition each coaxial jack 23 is set in can be easily recognized by sight according to a slide position of the corresponding slide switch 31.

Third Preferred Embodiment

FIGS. 8, 9, 10A, and 10B are views showing a coaxial conversion connector according to a third preferred embodiment of the present invention. Substantially the same parts as those in the first preferred embodiment will be denoted by the same reference numerals, and the description thereof will be omitted. In the third preferred embodiment, the pair of FG switching means each comprising the switching shaft 26 and the contact plate 27 in the first preferred embodiment are replaced by a pair of FG switching means each having the following configuration. That is, each FG switching means comprises a conductive wire 33 electrically connected to a barrel 23*a* of a coaxial jack 23 and a shell 25 rather than using any special switching means like the slide switch 31 used in the second preferred embodiment, wherein the conductive wire 33 is broken is required. That is, in setting each coaxial jack 23 to a short condition, the barrel 23*a* of the corresponding coaxial jack 23 and the shell 25 are electrically connected together by the wire 33 soldered thereto. Conversely, in setting each coaxial jack 23 to an open condition, the wire 33 connecting the barrel 23*a* to the shell 25 is removed or cut. According to the third preferred embodiment, the configuration can be made very simple.

What is claimed is:

1. A coaxial conversion connector adapted to be detachably connected to a mating connector of an electronic device having a frame ground portion electrically connected to a frame ground in the vicinity of said mating connector, said mating connector having a plurality of first connecting portions; said coaxial conversion connector comprising:

a coaxial jack adapted to receive a coaxial cable having one end equipped with a coaxial plug, said coaxial jack having a cylindrical first metal member adapted to be electrically connected through said coaxial plug to an outer conductor of said coaxial cable, and a second metal member adapted to be electrically connected through said coaxial plug to a central conductor of said coaxial cable;

a plurality of second connecting portions electrically connected to both said first metal member and said second metal member, said second connecting portions being adapted to be respectively electrically connected to said first connecting portions of said mating connector;

a first contact member provided in the vicinity of said second connecting portions, said first contact member being formed from an elastic metal member adapted to come into pressure contact with said frame ground portion of said electronic device; and a switching means for switching continuity and discontinuity between said outer conductor of said coaxial cable and said first contact member.

2. A coaxial conversion connector according to claim 1, wherein said switching means comprises:

a second contact member formed from an elastic metal plate continuous to said first contact member and slightly spaced from said first metal member in a free condition; and a switching member comprising a shaft portion rotatably supported, a knob portion formed integrally with said shaft portion at one end thereof, and a cam portion formed integrally with said shaft portion at an intermediate thereof, said cam portion having such a shape as to selectively urge said second contact member by rotation of said knob portion, thereby switching continuity and discontinuity between said first metal member and said second contact member.

3. A coaxial conversion connector according to claim 1, wherein said switching means comprises:

a pair of conductive wires electrically connected to said first metal member and said first contact member; and an electrical switch interposed and connected between said conductive wires, for switching continuity and discontinuity between said first metal member and said first contact member.

4. A coaxial conversion connector according to claim 1, further comprising a means for indicating the continuity and the discontinuity between said first metal member and said first contact member switched by said switching means.

5. A coaxial conversion connector according to claim 1, wherein said switching means comprises a conductive wire electrically connected to said first metal member and said first contact member, said conductive wire being selectively cut to switch the continuity and the discontinuity between said first metal member and said first contact member.

* * * * *